US009504881B2

(12) United States Patent
Hebert et al.

(10) Patent No.: US 9,504,881 B2
(45) Date of Patent: Nov. 29, 2016

(54) DEVICE AND METHOD FOR MARKING THE SURFACE OF A SPHERICAL OBJECT WHILE ROTATING THE SPHERICAL OBJECT IN ANY DIRECTION ABOUT ITS CENTER

(71) Applicant: Acushnet Company, Fairhaven, MA (US)

(72) Inventors: Edmund A. Hebert, Mattapoisett, MA (US); Douglas E. Jones, Dartmouth, MA (US); Derek A. Ladd, Acushnet, MA (US); Nicholas M. Nardacci, Bristol, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 14/308,847

(22) Filed: Jun. 19, 2014

(65) Prior Publication Data

US 2015/0367184 A1 Dec. 24, 2015

(51) Int. Cl.

| | |
|---|---|
| ***B41F 17/30*** | (2006.01) |
| ***A63B 45/02*** | (2006.01) |
| ***A63B 37/00*** | (2006.01) |
| *B41M 1/40* | (2006.01) |
| *B41J 3/407* | (2006.01) |

(52) U.S. Cl.

CPC ..... *A63B 45/02* (2013.01); *A63B 37/0022* (2013.01); *A63B 37/0003* (2013.01); *B41F 17/30* (2013.01); *B41J 3/4073* (2013.01); *B41M 1/40* (2013.01)

(58) Field of Classification Search

None

See application file for complete search history.

(56) References Cited

U.S. PATENT DOCUMENTS

| | | | | |
|---|---|---|---|---|
| 1,339,569 | A * | 5/1920 | Lyon | 101/7 |
| 1,551,376 | A * | 8/1925 | Duchemin | 101/7 |
| 4,745,857 | A * | 5/1988 | Putnam et al. | 101/44 |
| 4,836,119 | A * | 6/1989 | Siraco et al. | 112/306 |
| 5,632,205 | A | 5/1997 | Gordon et al. | |
| 6,245,386 | B1 | 6/2001 | Felker et al. | |
| 6,295,737 | B2 * | 10/2001 | Patton et al. | 33/18.1 |
| 6,418,843 | B1 * | 7/2002 | Givler | 101/35 |
| 6,538,767 | B1 * | 3/2003 | Over et al. | 358/1.18 |
| 7,063,747 | B2 | 6/2006 | Lastowka | |
| 7,407,250 | B2 * | 8/2008 | Jones et al. | 347/16 |
| 7,448,323 | B2 * | 11/2008 | Kennedy et al. | 101/491 |
| 7,972,221 | B2 | 7/2011 | Furze et al. | |
| 7,992,851 | B2 | 8/2011 | Vieira et al. | |
| 8,008,641 | B2 | 8/2011 | Harris et al. | |

(Continued)

OTHER PUBLICATIONS http//www/makerbot.com/blog/2011/04/18, Apr. 18, 2011.

(Continued)

*Primary Examiner* — Jill Culler

(74) *Attorney, Agent, or Firm* — Margaret C. Barker

(57) ABSTRACT

A device and method for marking a spherical golf ball component, comprising: at least one rotation support; at least one spherical golf ball component having a center and an outer surface; wherein each spherical golf ball component is mountable on the rotation support such that the spherical golf ball component is rotatable in any direction about its center; and at least one marking arm that marks the outer surface while the spherical golf ball component is rotating. At least one marking arm may be motionless while marking the spherical golf ball component, or the marking arm may be motionless at least temporarily while marking the spherical golf ball component, or the marking arm may be movable to mark the outer surface.

15 Claims, 14 Drawing Sheets

(56) References Cited

U.S. PATENT DOCUMENTS

| | | | | |
|---|---|---|---|---|
| 2002/0134257 | A1* | 9/2002 | Stephenson | 101/35 |
| 2004/0115360 | A1 | 6/2004 | Clifford et al. | |
| 2006/0292308 | A1 | 12/2006 | Clifford et al. | |
| 2008/0083371 | A1 | 4/2008 | Clifford et al. | |
| 2009/0017212 | A1 | 1/2009 | Clifford | |
| 2010/0151971 | A1 | 6/2010 | Mydlack et al. | |
| 2010/0196616 | A1 | 8/2010 | Clifford | |
| 2014/0066229 | A1 | 3/2014 | Kuntimaddi | |

OTHER PUBLICATIONS http://www.makerbot.com/blog/tag/eggbot/, Apr. 28, 2011.
http://www/makerbot.com/blog/tag/eggbot/, Mar. 13, 2012.
http://www.flickr.com/photos/oskay/5078229713/, Sep. 25, 2010.

* cited by examiner

DEVICE AND METHOD FOR MARKING THE SURFACE OF A SPHERICAL OBJECT WHILE ROTATING THE SPHERICAL OBJECT IN ANY DIRECTION ABOUT ITS CENTER

FIELD OF THE INVENTION

Devices and methods for marking (e.g., decorating, designing, painting, and/or etching) the surface of a spherical object such as a golf ball.

BACKGROUND OF THE INVENTION

Golf balls generally comprise a core surrounded by a cover and optionally intermediate layers there between. The cover forms a spherical outer surface and typically includes a plurality of dimples. The core and/or the cover may incorporate multiple layers and the core may be solid or have a fluid-filled center surrounded by windings and/or molded material. Golf ball covers may be formed from a variety of materials such as balata, polyurethane, polyurea, and/or thermoplastic compositions and ionomer resins such as SURLYN® and IOTEK®, depending upon the desired performance characteristics of the golf ball and desired properties of the cover.

Golf balls are conventionally white, but may also be manufactured with essentially any desired solid color. The solid color may be incorporated in the cover material itself or be applied to the cover outer surface as a coating. Typically, in a painted golf ball, a first coat or primer layer of paint is applied, followed by a second, i.e., finishing coat or layer.

Some golfers enjoy distinguishing themselves on the green by playing a golf ball having a unique visual appearance. And many of those golfers prefer the unique overall golf ball color appearance achieved where color/designs or other distinguishing markings such as logos are applied onto a golf ball outer surface.

In this regard, manual golf ball surface customization using permanent marker to ink multiple colors onto a golf ball surface is known. Additionally, printing and stamping methods/systems also exist for applying localized multi-color indicia/markings such as a trademark, logo, design, identification number, model name and/or number onto a golf ball surface. In such systems, ink is applied to a prefab printing plate or stamp which is then applied onto a limited portion of the golf ball surface. Digital images have been created and uploaded into a program, golf balls loaded into a printer, and then the prefab multi-color digital image applied to a portion of the golf ball surface.

In one automated approach, distinguishing markings are added onto a golf ball outer surface by masking a portion of the golf ball outer surface followed by painting/coating the outer surface a different hue or shade than that of the masked surface portion. The masking may have cut-outs in the shape of a desired distinguishing marking as well. See U.S. Publ. No. 2014/0066229 A1 of Kuntimaddi, hereby incorporated by reference herein in its entirety.

In other approaches, a spherical object is gripped, grasped, engaged or otherwise held in place by holders, spindles, prongs, grippers, clamps, cavity cups, hemispherical cups, and/or vacuum cups for the purpose of either marking the spherical object or inspecting it. See e.g. U.S. Pat. No. 6,245,386 of Felker et al., U.S. Pat. No. 7,063,747 of Lastowka et al., U.S. Pat. No. 7,972,221 of Furze et al., U.S. Pat. No. 7,992,851 of Vieira et al., and/or U.S. Publ. No. 2010/0151971A1 of Mydlack et al. See also, Egg-Bot videos @ Youtube.com.

For example, in the Egg-Bot device, opposing grips (clamps) and a spherical object secured there between are collectively rotated about a single axis that is orthogonal to the direction that a marker is meanwhile oscillating and providing distinguishing markings onto the spherical object's outer surface. In this device, such rotation about the single axis may be in a clockwise and/or counterclockwise direction. Accordingly, the spherical object and the marker each have one degree of freedom with respect to each other.

A notable drawback with each of these devices, however, is that the vacuum cups, cavity cups, spindles, clamps, etc. obstruct at least the portion of the spherical object surface they secure, thereby preventing marking of the entire surface without temporarily suspending operation to reposition the spherical object within the securing means of choice.

One spatial orientation device manages to rotate a spherical object into a predetermined marking position without spindles, grips or the like by contacting the spherical object with two rotating wheels or two elongated supports. However, in this apparatus, direct rotation of the sphere is only possible about two orthogonal axes. Additionally, marking occurs once the spherical object has settled into a predetermined position. See U.S. Pat. No. 5,632,205 of Gordon et al.

Therefore, there is a need for an automated marking device and method wherein a spherical object is rotatable in any direction about its center while the spherical object's surface is marked, and without interruption. Such a device would be desirably time efficient and cost effective. The present invention addresses and solves these needs.

SUMMARY OF THE INVENTION

Accordingly, a device and method of the invention permits a spherical golf ball component (and spherical objects in general) to be marked while rotating in a plurality of directions about its center, without sacrificing the precision that is necessary for marking.

The device comprises at least one rotation support and at least one spherical golf ball component having a center and an outer surface. Each spherical golf ball component is mountable on the rotation support such that the spherical golf ball component is rotatable in a plurality of directions about its center. Meanwhile, at least one marking arm, having n degrees of freedom with respect to the outer surface, wherein $n \geq 2$, is movable to mark the outer surface while the spherical golf ball component is rotating.

As used herein, the term "spherical golf ball component" shall refer to any spherical object, but in particular, to at least one of a golf ball core; a core and an intermediate layer; a core and a cover; and a core, an intermediate layer and a cover. In one embodiment, a coating layer is disposed about the spherical golf ball component.

Several non-limiting embodiments of the rotation support are as follows. In a first embodiment, the rotation support comprises three rods that are angled at substantially 60° to each other. Each rod has at least one rotating member rotatable about it in at least one of a clockwise and counterclockwise direction. Rotating members may be included which traverse the rod as well as rotate about it. Moreover, a rod may alternatively or additionally comprise at least one integral rotating member such that the rotating member is rotatable in at least one of a clockwise and counterclockwise direction.

Rotation members may comprise any form shaped to support a spherical golf ball component and rotate it in a plurality of directions about its center without changing the location of the spherical golf ball component's center. For example, a rotating member may comprise an arched surface for contacting the spherical golf ball component. Rotating members may also comprise a surface shaped to frictionally mount the spherical golf ball component.

In a second non-limiting embodiment, the rotation support comprises three posts, wherein at least one of the three posts is orthogonal to another of the posts, each post having a spherical rotating member rotatably secured to it, and the posts being spaced from each other such that the spherical rotating members collectively support and rotate a spherical golf ball component in any direction about its center.

In a third non-limiting embodiment, the rotation support comprises at least three sockets, each socket rotatably housing a spherical rotating member, the sockets being spaced from each other such that the spherical rotating members collectively support and rotate a spherical golf ball component in any direction about its center.

In a sphere, each axis of rotation is defined by a line joining two diametrically opposed or "antipodal" points of contact on the sphere's surface (spaced 180° apart) and intersecting the sphere's center. Since two opposing/antipodal surface points form one axis, there are actually P/2 different possible axes of rotation, wherein P is the number of preselected contact points on the spherical golf ball component's outer surface that are contacted by the marking arm during the marking process. In a device and method of the invention, the spherical golf ball component is directly rotatable about any of these possible P/2 axes while the spherical golf ball component is marked. The spherical golf ball component may alternatively be directly rotatable about A axes, wherein $2 \leq A \leq P/2$, wherein at least one of A axes of rotation is not orthogonal to at least one other axis of rotation.

The term "mark" and/or "marking", as used herein, includes but is not limited to at least one of the following: (i) providing/applying distinguishing marking such as designs, indications of origin, and/or other cosmetic coloring/decorations/patterns onto the surface of a spherical golf ball component; (ii) etching or otherwise cutting a portion of a golf ball component surface in order to engrave or create dimple pattern for example; (iii) provide landscape texture differences between marked and unmarked portions of a golf ball component surface by providing a texturing composition onto a portion of the outer surface.

A marking arm may include a pen, brush, air brush, sprayer, applicator, cutting instrument, needles, etching tool, and/or cutting tool. The marking arms may mark any desired marking pattern onto the spherical golf ball component's outer surface. Each marking arm is extendable and retractable to mark the outer surface of the spherical golf ball component as the spherical golf ball component rotates in any direction about its center. Each marking arm may also be movable above an arc about the spherical golf ball component center. Two or more marking arms may be arranged such that they can mark the spherical golf ball surface simultaneously, sequentially, or a combination thereof. The marking arms may be configured, for example, to mark a marking pattern onto the spherical golf ball component's surface at two opposing poles and along the golf ball component's equator at four equi-spaced locations.

Where a marking arm provides a marking composition onto the spherical golf ball component for coloring or texturing for example, the a marking composition may comprise any known composition or medium suitable for coloring and/or creating a distinguishing marking on the surface such as paints or waxes. In this regard, it is envisioned that the marking composition may include both colored and colorless mediums, as well as clear, translucent and/or opaque marking compositions. The marking arm may further include a light source or other device for inspecting the surface of the spherical object while the spherical object rotates.

In one embodiment, the device for marking a spherical golf ball component comprises at least one rotation support and at least one spherical golf ball component having a center and an outer surface, wherein each spherical golf ball component is mountable on the rotation support such that the spherical golf ball component is rotatable in any direction about its center. At least one marking arm marks the outer surface while the spherical golf ball component is rotating. The marking arm may be motionless while marking the spherical golf ball component. Alternatively, the marking arm may be motionless at least temporarily while marking the spherical golf ball component. Or, the marking arm may be movable to mark the outer surface. In this regard, the marking arm may be movable as selected or predetermined before, during and/or following the golf ball marking step.

A device for marking a spherical golf ball component surface may also comprise: a rotation support; at least one spherical golf ball component having a center and an outer surface; wherein each spherical golf ball component is mountable on a rotation support such that the spherical golf ball component is rotatable in any direction about it center; at least two marking arms that are located to mark the outer surface while the spherical golf ball component is rotating; and a processing device that coordinates marking of the outer surface by each marking arm.

The invention also relates to a method for marking a golf ball component surface comprising: mounting at least one spherical golf ball component having a center and an outer surface on a rotation support; and marking the outer surface while rotating the spherical golf ball component in a plurality of directions about the center.

In yet another embodiment, the method for marking a golf ball component surface comprises: providing at least one spherical golf ball component to be marked having a center and an outer surface; mounting the at least one spherical golf ball component on a rotation support; and marking the outer surface with at least one marking arm having n degrees of freedom with respect to the outer surface, wherein $n \geq 2$ while rotating the spherical golf ball component in any direction about the center.

BRIEF DESCRIPTION OF THE DRAWINGS

The accompanying drawings form a part of the specification and are to be read in conjunction therewith. The illustrated embodiments, however, are merely examples and are not intended to be limiting. Like reference numerals and designations in the various drawings indicate like elements.

FIG. 4B is a side view of the rotation support depicted in FIG. 4A;

DETAILED DESCRIPTION

The present invention is directed to a device and method for advantageously marking the surface of a spherical object while the spherical object rotates in any direction about its center and without interrupting the marking process to reposition the spherical object. Direct rotation about any of P/2 axes is possible, wherein P is the number of preselected contact points on the spherical golf ball component's outer surface that are contacted by the marking arm during the marking process.

The spherical golf ball component is also directly rotatable about A axes, wherein $2 \leq A \leq P/2$. In another embodiment, $3 \leq A \leq P/2$. In yet another embodiment, $4 \leq A \leq P/2$. In still another embodiment, $6 \leq A \leq P/2$. In alternative embodiments, $10 \leq A \leq P/2$, or $25 \leq A \leq P/2$, or $50 \leq A \leq P/2$, or $100 \leq A \leq P/2$, or $200 \leq A \leq P/2$, or $300 \leq A \leq P/2$.

In one embodiment, 50% of $4 \leq A \leq P/2$ axes of rotation have a successive axis of rotation or a preceding axis of rotation that is not orthogonal to it. In yet another embodiment, 40% to 50% of $5 \leq A \leq P/2$ axes of rotation have a successive axis of rotation or a preceding axis of rotation that is not orthogonal to it. In still another embodiment, 30% to 40% of $10 \leq A \leq P/2$ axes of rotation have a successive axis of rotation or a preceding axis of rotation that is not orthogonal to it. In an alternative embodiment, 20% to 30% of $5 \leq A \leq P/2$ axes of rotation have a successive axis of rotation or a preceding axis of rotation that is not orthogonal to it. In a different embodiment, 10% to 20% of $10 \leq A \leq P/2$ axes of rotation have a successive axis of rotation or a preceding axis of rotation that is not orthogonal to it. In one embodiment, 1% to 10% of $100 \leq A \leq P/2$ axes of rotation have a successive axis of rotation or a preceding axis of rotation that is not orthogonal to it.

Figure 1A:
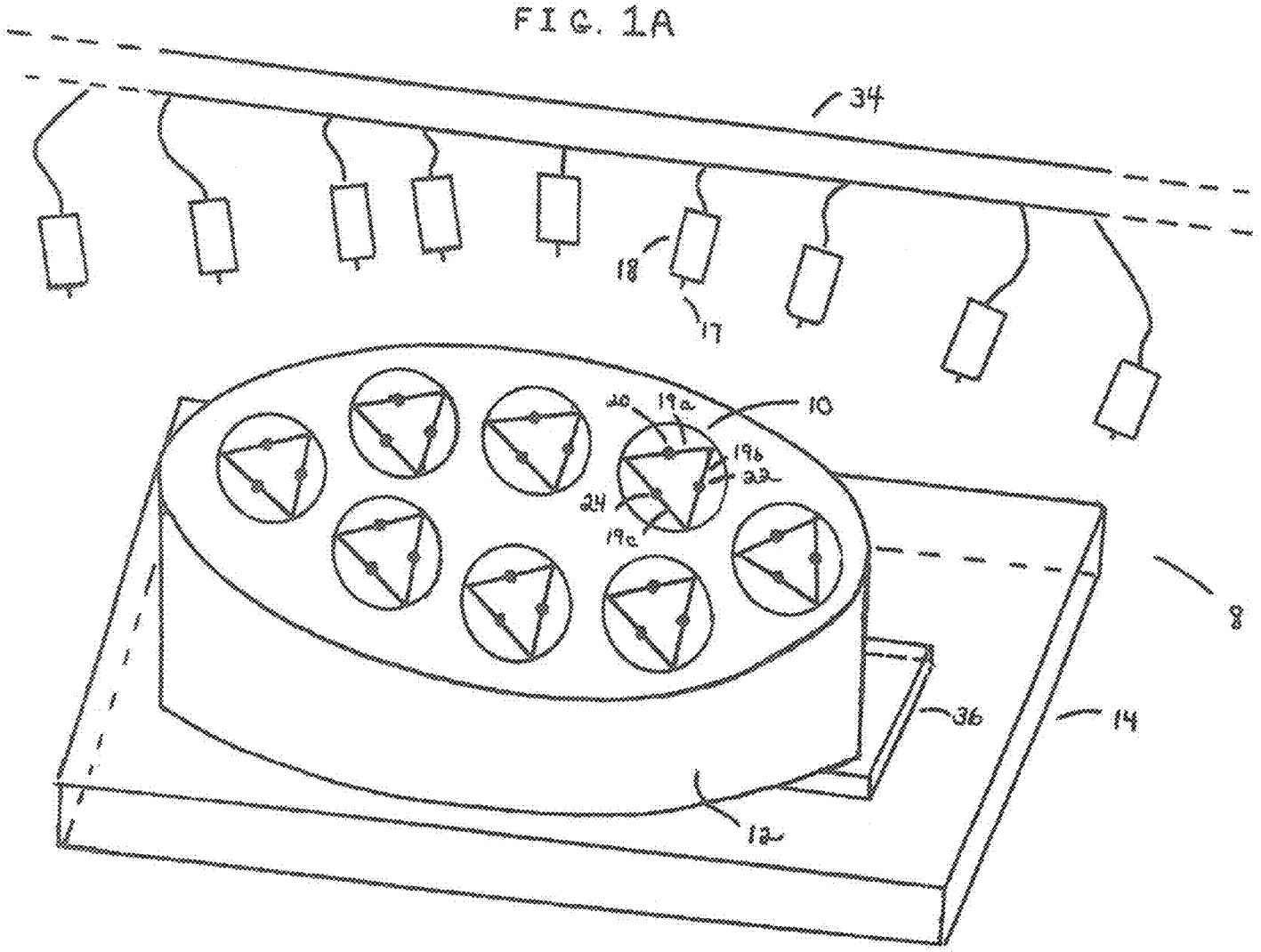
FIG. 1A is a pictorial view of one embodiment of a marking device or system of the invention for marking at least one spherical golf ball component while the spherical golf ball component rotates in any direction about its center.

In this regard, FIG. 1A illustrates one embodiment of a device of the invention for rotating a spherical golf ball component about both its center and at least one of the possible rotation axes as defined herein while at least one marking arm marks the outer surface of the spherical golf ball component. The term "spherical golf ball component" will be understood to refer to any spherical object, including in particular at least one of a golf ball core; a core and an intermediate layer; a core and a cover; and a core, an intermediate layer and a cover. In one embodiment, a coating layer is disposed about the spherical golf ball component.

Specifically, referring to FIG. 1A, device 8 includes one or more rotation supports 10 supported upon platform 12. Platform 12 is optionally rotatable in a direction that is substantially parallel with stationary base portion 14. Platform 12 may be rotatable, for example, in order urge rotation supports 10 toward marking arms 18 during the marking process. Additionally, rotation of platform 12 may aid in mounting and/or dismounting spherical golf ball components prior to and/or following marking. Base portion 14 may cooperate with platform 12 to rotate platform 12.

In the embodiment of the device/system of the invention depicted in FIG. 1A, each rotation support 10 includes three rods 19*a*, 19*b*, and 19*c* are angled at substantially 60°, each of rods 19*a*, 19*b*, and 19*c* including rotating members 20, 22 and 24, respectively. It will be appreciated that Rods 19*a*, 19*b*, and 19*c* may be angled at any suitable angle. For example, rods 19*a* and 19*b* may be angled at substantially 90°, with rods 19*c* and 19*b* being angled at substantially 45°, and rods 19*c* and 19*a* likewise being angled at substantially 45°. In yet another arrangement, rods 19*a* and 19*b* may be angled at substantially 30°, with rods 19*c* and 19*b* being angled at substantially 60°, and rods 19*c* and 19*a* being angled at substantially 90°.

Rotating members 20, 22 and 24 of FIG. 1A are mounted on rods 19*a*, 19*b*, and 19*c* so as to collectively support a spherical golf ball component and rotate it in any direction about its center. For example, rods 19*a*, 19*b*, and 19*c* may thread rotating members, 20, 22 and 24, respectively, with rotating members, 20, 22 and 24 each being rotatable about their respective rod in a clockwise and/or counterclockwise direction. Rotating members, 20, 22 and 24 may each also transverse their respective rod. Alternatively, rotating members 20, 22 and 24 may be integral with their respective rods 19*a*, 19*b* and 19*c*. Rods 19*a*, 19*b*, and 19*c* are rotatable independently of each other when integrally rotatable with rotating members, 20, 22 and 24, respectively.

Figure 1B:
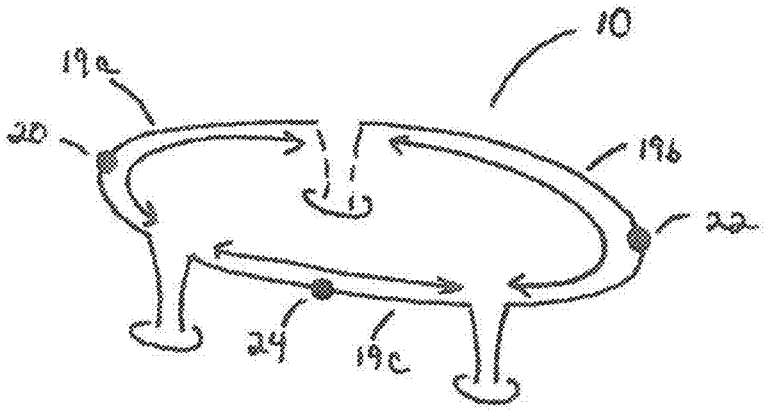
FIG. 1B depicts a rotation support having curved rods, each rod having ends that are adjacent to a different rod, and each rod rotatably mounting a rotation member that can also transverse the rod it rotatably mounts.

While rods 19*a*, 19*b* and 19*c* as depicted in FIG. 1A are linear, embodiments are also envisioned wherein rods 19*a*, 19*b* and 19*c* may be curved or arched and arranged in a circle, oval, ellipse, or other track-like arrangement, for example as shown in FIG. 1B. Specifically, rotation support 10 of FIG. 1B includes curved rods 19*a*, 19*b*, and 19*c*. Each of rods 19*a*, 19*b*, and 19*c* has ends that are adjacent to a different rod. Rotating members, 20, 22 and 24 are each rotatable about their respective rod in a clockwise and/or counterclockwise direction. Additionally, rotating members 20, 22 and 24 and can transverse the rod it is rotatable about either before, during or following rotation. Of course, other embodiments are also envisioned, such as wherein the rod arrangement includes only two curved rods, each rod forming a semi-circle and being adjacent at their respective ends.

Figure 1C:
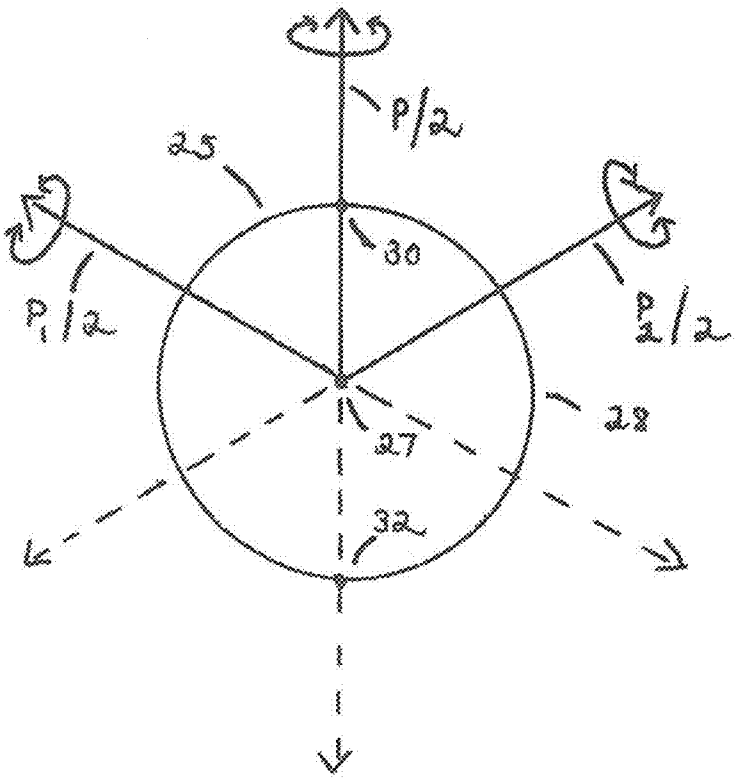
FIG. 1C is a perspective view illustrating the P/2 possible axes about which a spherical golf ball component may be rotated when mounted in a rotation support in a device of the invention such as that depicted in FIG. 1A.

It will be appreciated that a rod may thread or otherwise include more than one rotating member. All rotating members which cooperate to urge a spherical golf ball component such as spherical golf ball component 25 of FIG. 1C in any desired direction about its center 27 while at least one marking arm 18 marks the outer surface 28 of the spherical golf ball component. FIG. 1C depicts spherical golf ball component 25 having center 27. Spherical golf ball component 25 has P/2 possible axes about which spherical golf ball component 25 is rotatable. Axis P/2 includes antipodal surface points 30 and 32 and intersects center 27. Spherical golf ball component 25 is rotatable about each of the P/2 axes in both a clockwise and counter clockwise direction. It will be appreciated that spherical golf ball component 25 of FIG. 1C has many axes of rotation not shown therein, such as axes of rotation $P_1/2$ and $P_2/2$, which are included in FIG. 1C for illustration purposes.

Meanwhile, referring back to FIG. 1A, processing device 36 may time and coordinate both rotation and spacing of rotating members 20, 22 and 24 about rods 19*a*, 19*b*, and 19*c* in order to urge spherical golf ball component 25 in a particular direction about its center. In the embodiment depicted in FIG. 1A, base portion 14 houses the processing device 36, although it is envisioned that other locations for processing device 36 are possible. It is also contemplated that such communication may be analog, digital, wireless, or by any other known means for transmitting and/or communicating and/or coordinating data or information.

Track 34 of FIG. 1A adjustably receives at least one marking arm 18. Track 34 may be linear or circular, rectangular, open, closed, conveyer-like or have any shape or configuration that permits marking arms 18 to extendably and retractably access any surface portion to be marked. In turn, each marking arm 18 is extendably and movably received within track 34 and has two or more degrees of freedom with respect to any outer surface to be marked. Marking arms 18 may operate simultaneously, in tandem or consecutively to mark the surface of a spherical golf ball component surface while the spherical golf ball component is rotating in any direction about its center.

Each marking arm 18 includes a marking tip 17 which may comprise a pen, brush, air brush, sprayer, applicator, cutting instrument, needles, etching tool, and/or cutting tool, for example for marking the spherical golf ball component outer surface. It will be appreciated that marking tip 17 may comprise any mechanism suitable for marking the spherical golf ball component outer surface 28 in order to provide a distinguishing marking thereon, or to cut, etch, or for texturing outer surface 28, for example. It is contemplated that marking arm 18 and marking 17 are adapted to apply or otherwise provide any medium onto outer surface 28 such as colorants (e.g. paints, dyes, inks). Marking tip 17 may be adapted to mark outer surface 28 with indications of origin such as logos, some of which are quite detailed and require precision. In one embodiment, marking tip 17 of marking arm 18 may cut dimples into outer surface 28 or highlight adjacent edges of dimples with an ink or other colorant.

In one embodiment, track 34 and/or marking arms 18 are in communication with processing device 36 to time and coordinate marking the golf ball component surface with both rotation and spacing of rotating members. In another embodiment, processing device 36 recognizes and optionally stores a predetermined marking pattern for marking onto each spherical golf ball component 25, and assigns at least a portion of the marking pattern to each marking arm 18. Each marking arm 18 has a mapping mechanism that: (i) receives at least a portion of the marking pattern from processing device 36 and recognizes its portion; (ii) positions the marking arm 18 in relation to each golf ball component surface to be marked; and (iii) marks the golf ball component outer surface with at least a portion of the marking pattern while the golf ball component surface is rotating.

In yet another embodiment, the processing device 36 stores a predetermined marking pattern and communicates the marking pattern to each marking arm 18. Each marking arm 18 has a mapping mechanism that: identifies which portions of the marking pattern are assigned to it; maps its portions onto the outer surface; communicates with at least one other marking arm 18 so as to coordinate placement of its portion onto the outer surface; and marks the outer surface with its portion while the spherical golf ball component is rotating.

In still another embodiment, processing device 36 assigns a portion of a predetermined marking pattern to each marking arm 18 and coordinates marking of each outer surface 28 by each marking arm 18 while the spherical golf ball component rotates in any direction about the center.

In a different embodiment, the processing device 36 stores a predetermined marking pattern and assigns a portion of the marking pattern to each marking arm 18. Each marking arm 18: receives and recognizes the portion assigned to it by the processing device 36 and marks the outer surface while the spherical golf ball component rotates in any direction about the center.

In an alternative embodiment, the processing device 36 communicates to each marking arm 18 a portion of a marking pattern. Each marking arm 18 has a mapping mechanism that: receives the portion from the processing device 36; maps the portion onto a predetermined outer surface of a spherical golf ball component to be marked; and synchronizes marking its portion of the marking pattern onto the outer surface while the spherical golf ball component rotates in any direction about the center.

In a further embodiment, each marking arm 18 comprises the processing device and coordinates marking of the golf ball component outer surface with the predetermined marking pattern while the spherical golf ball component rotates in any direction about its center. In this embodiment, where two or more marking arms 18 operate to mark the same outer surface with a different portion of the predetermined marking pattern, then each marking arm 18 synchronizes marking its portion of the marking pattern onto the outer surface with any other marking arm 18 also marking a portion of the marking pattern onto the outer surface.

Marking arms 18 may each have a motion sensor that tracks/monitors rotation and position with respect to the spherical golf ball component and times/coordinates marking in relation to spherical golf ball component rotation and position.

One marking arm 18 may comprise a motion sensing element that senses the location or position of a second marking arm 18 in relation to its own location or position and adjust its own location or position in relation to that second marking arm's location or position within one second or less of sensing the location or position of the second applicator. In another embodiment, one marking arm 18 may comprise a motion sensing element that senses the location or position of a second marking arm 18 in relation to its own location or position and adjust its own location or position in relation to the second marking arm's location or position within two seconds or less of sensing the location of the second marking arm. In yet another embodiment, each marking arm 18 comprises a motion sensing element that senses the location or position of another second marking arm in relation to its own location or position and adjusts its own location or position in relation to another marking arm's location or position within five seconds or less of sensing the location of the second marking arm. In a different embodiment, the motion sensing element is remote from each marking arm 18 and information regarding another marking arm's location or position is transmitted to each marking arm 18.

The marking pattern may mark any portion of the golf ball component's surface area. For example, the marking pattern may be marked on about 0.50% or greater of the golf ball component's surface area. In one embodiment, is marked on from about 2% to about 5% of the golf ball component surface area. In another embodiment, the marking pattern is marked on about 25% or greater of the golf ball component surface area. In yet another embodiment, the marking pattern is marked on greater than 50% of the golf ball component surface area. In still another embodiment, is marked on at least about 75% of the golf ball component surface area. In an alternative embodiment, the marking pattern is marked on about 90% or greater of the golf ball component surface area. In a different embodiment, the marking pattern is marked on from 90% to 100% of the golf ball component surface area.

The marking pattern may comprise any number of sub-patterns. The marking pattern includes sub-patterns where the marking pattern has visually distinct sections. For example, the marking pattern may be marked on the spherical golf ball component's surface in sub-patterns located at two opposing poles and along the golf ball component's equator at four equi-spaced locations. In another example, the marking pattern comprises a logo on one quadrant on the spherical golf ball component surface, and a different distinguishing marking in a different quadrant. Sub-patterns may be identical or different or partially identical. Sub-patterns may be symmetrical or asymmetrical, or a combination thereof. The marking pattern may comprise identical sub-patterns that are equally spaced or have different spacing on the golf ball component surface when the marking pattern is marked on the surface. In one embodiment, the marking pattern comprises two equi-spaced identical sub-patterns. In another embodiment, the marking pattern comprises two equi-spaced sub-patterns that are different.

Figure 2A:
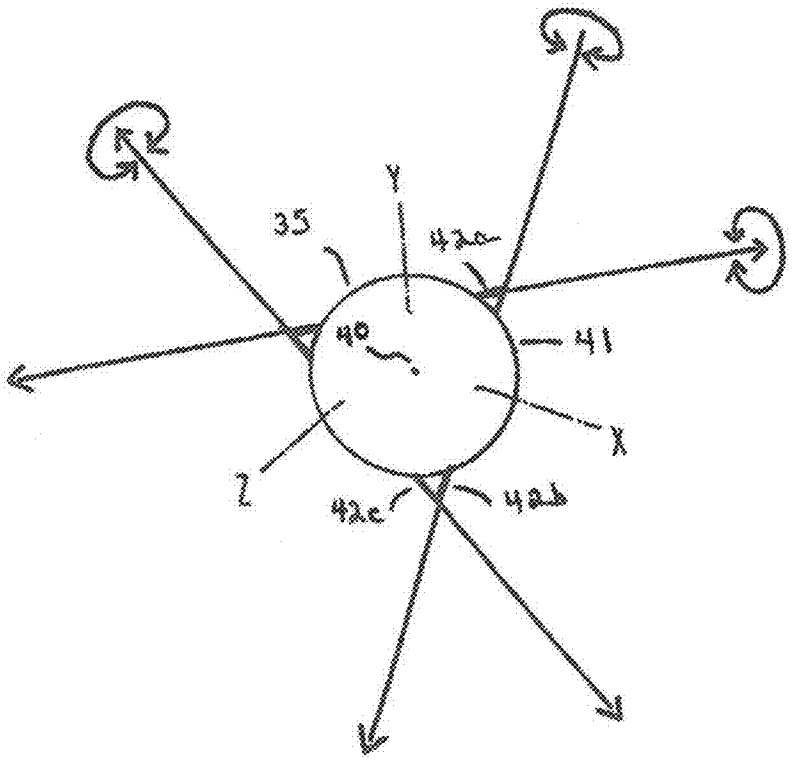
FIG. 2A is a top schematic view of a spherical golf ball component mounted on a golf ball rotation support such that the spherical golf ball component may be rotated in any direction about its center according to one embodiment of the invention.
Figure 2B:
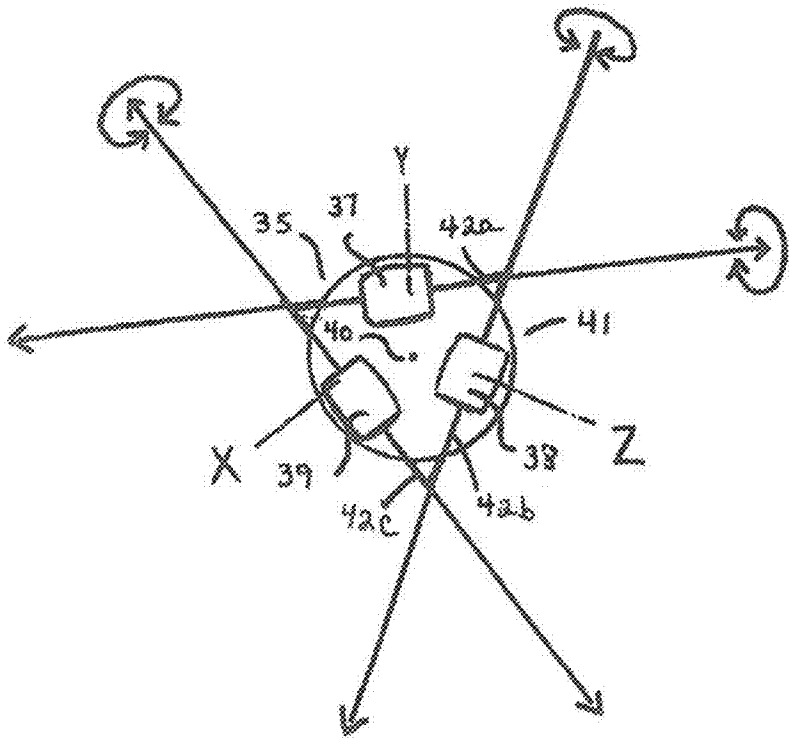
FIG. 2B is a bottom schematic view of the embodiment of the invention depicted in FIG. 2A.

Rotating members may have any shape capable of supporting a spherical golf ball component and collectively rotating it. For example, FIGS. 2A and 2B depict top and bottom views, respectively, of an embodiment including elongated and barrel-shaped rotating members 37, 38 and 39 (shown in FIG. 2B) rather than being spherical as are rotating members 20, 22 and 24. In this embodiment, spherical golf ball component 35 having center 40 is mounted on support 41. In support 41, rods 42*a*, 42*b* and 42*c* thread rotating members 37, 38 and 39, respectively, and rotating members 37, 38 and 39 are rotatable about rods 42*a*, 42*b* and 42*c* in clockwise and/or counter clockwise directions as desired to rotate the spherical golf ball component 35 in any direction about its center 40.

Optionally, barrel-shaped rotating members 37, 38 and 39 may traverse their respective rods, that is, be movable along rods 42*a*, 42*b* and 42*c* as needed to change or redirect golf ball components 35 rotation in a particular direction about its center 40. And rotating members 37, 38 and 39 may be movable simultaneously or sequentially depending on the desired direction of rotation for the spherical golf ball component 35.

Figure 3A:
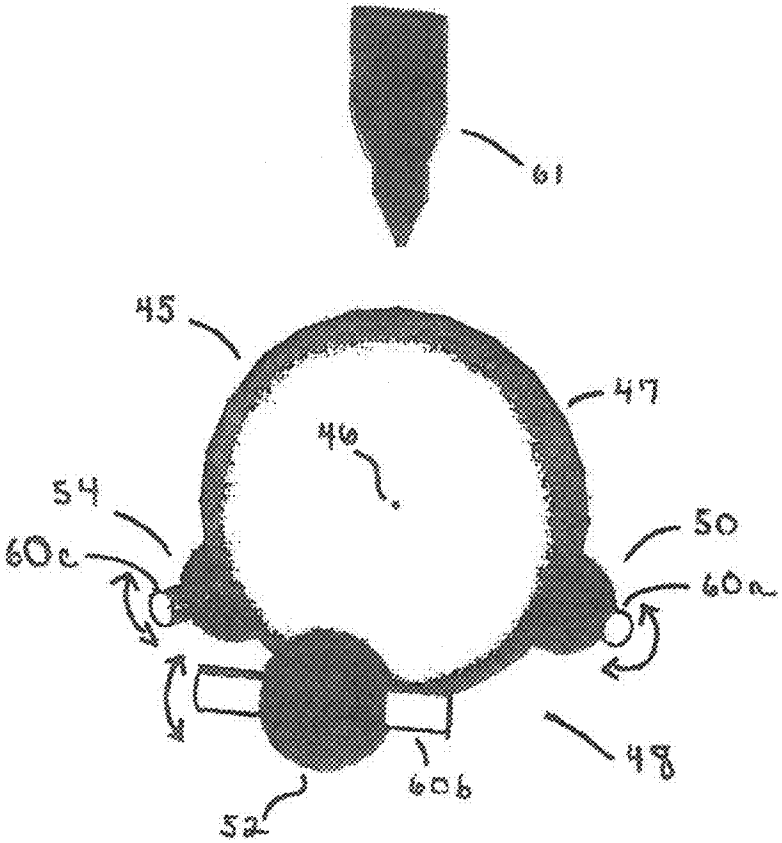
FIG. 3A is a side view of a rotation support for rotating a spherical golf ball component in any direction about its center according to a different embodiment of the invention.
Figure 3B:
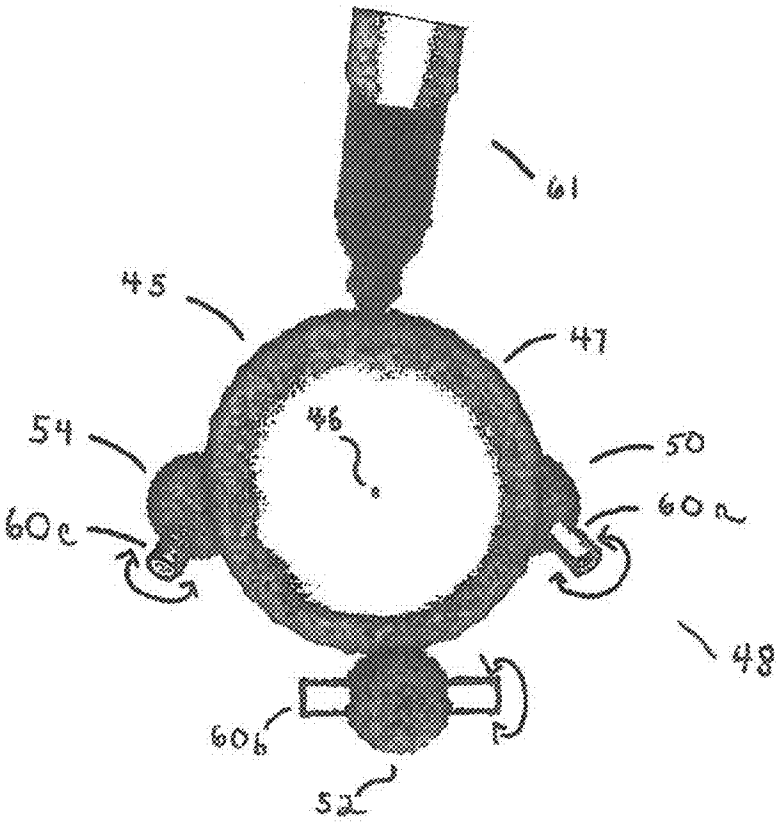
FIG. 3B is an elevated view of the rotation support depicted in FIG. 3A.
Figure 3C:
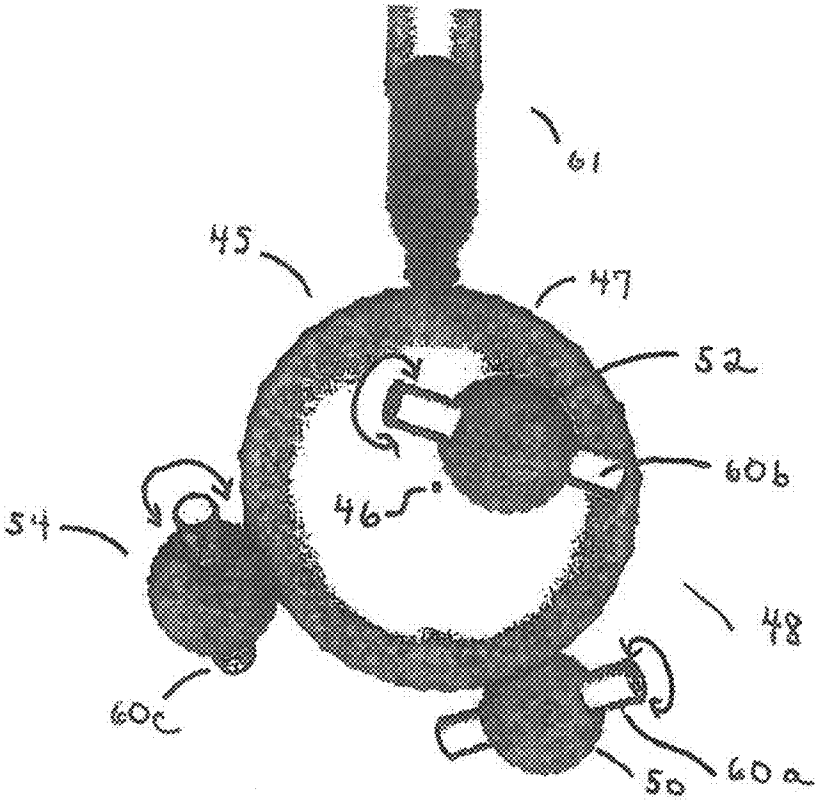
FIG. 3C is a bottom view of the rotation support depicted in FIG. 3A.

FIGS. 3A, 3B and 3C depict three different views of spherical golf ball component 45, having center 46 and outer surface 47, being supported on rotation support 48. Support 48 includes three rotating members 50, 52, 54, each mounted and rotatable about their respective rods 60*a*, 60*b*, and 60*c*. Golf ball component 45 is rotatable in any direction about its center 46 while marking arm 61 marks outer surface 47.

In some embodiments, rotating members may cooperate by collectively rotating in a clockwise direction to urge a spherical golf ball component in a certain direction about its center. The rotation members may alternatively rotate collectively in a counter clockwise direction to urge the golf ball component in any desired direction about the golf ball component's center. Of course, one or more rotating members may rotate in a clockwise direction while one or more rotating members rotate in a counter clockwise direction. In other embodiments, cooperation includes at least one rotating member remaining stationary, at least temporarily, while other rotating members so rotate. In yet other embodiments, cooperation includes timing or staggering rotation of each rotating member in order to urge the golf ball component to rotate in a particular direction about its center while being marked.

The following permutations demonstrate how rotating members 20, 22 and 24 (as well as rotating members 37, 38 and 39 or 50, 52 and 54) may cooperate with each other in FIGS. 1A, 2A and 2B and FIGS. 3A, 3B, 3C to rotate a spherical golf ball component in any direction about its center. Each permutation, while specifically referring to rotating members 20, 22 and 24 and rods 19*a*, 19*b*, 19*c*, is also applicable to rotating members 37, 38 and 39 or 50, 52 and 54 and rods 42*a*, 42*b* and 42*c* or 60*a*, 60*b*, and 60*c*, respectively. Such permutations include, for example: (i) rotating member 20 rotates about rod 19*a* in a clockwise direction, rotating member 22 rotates about rod 19*b* in a clockwise direction, and rotating member 24 rotates about rod 19*c* in a clockwise direction; (ii) rotating member 20 rotates about rod 19*a* in a counter clockwise direction, rotating member 22 rotates about rod 19*b* in a counter clockwise direction, and rotating member 24 rotates about rod 19*c* in a counter clockwise direction; (iii) rotating member 20 rotates about rod 19*a* in a clockwise direction, rotating member 22 rotates about rod 19*b* in a clockwise direction, and rotating member 24 rotates about rod 19*c* in a counter clockwise direction; (iv) rotating member 20 rotates about rod 19*a* in a clockwise direction, rotating member 22 rotates about rod 19*b* in a counter clockwise direction, and rotating member 24 rotates about rod 19*c* in a clockwise direction; (v) rotating member 20 rotates about rod 19*a* in a counter clockwise direction, rotating member 22 rotates about rod 19*b* in a clockwise direction, and rotating member 24 rotates about rod 19*c* in a clockwise direction; (vi) rotating member 20 rotates about rod 19*a* in a clockwise direction, rotating member 22 rotates about rod 19*b* in a counter clockwise direction, and rotating member 24 rotates about rod 19*c* in a counter clockwise direction; (vii) rotating member 20 rotates about rod 19*a* in a counter clockwise direction, rotating member 22 rotates about rod 19*b* in a counter clockwise direction, and rotating member 24 rotates about rod 19*c* in a clockwise direction; and (viii) rotating member 20 rotates about rod 19*a* in a counter clockwise direction, rotating member 22 rotates about rod 19*b* in a clockwise direction, and rotating member 24 rotates about rod 19*c* in a counter clockwise direction.

In the following additional permutations, at least one rotating member may be stationary, at least temporarily, so as to influence or change the direction in which the golf ball component rotates about its center: (i) rotating member 20 is stationary, rotating member 22 rotates about rod 19*b* in a counter clockwise direction, and rotating member 24 rotates about rod 19*c* in a counter clockwise direction; (ii) rotating member 20 is stationary, rotating member 22 rotates about rod 19*b* in a clockwise direction, and rotating member 24 rotates about rod 19*c* in a clockwise direction; (iii) rotating member 20 is stationary, rotating member 22 rotates about rod 19*b* in a counter clockwise direction, and rotating member 24 rotates about rod 19*c* in a clockwise direction; (iv) rotating member 20 is stationary, rotating member 22 rotates about rod 29*b* in a clockwise direction, and rotating member 24 rotates about rod 19*c* in a counter clockwise direction; (v) rotating member 20 rotates about rod 19*a* in a clockwise direction, rotating member 22 is stationary, and rotating member 24 rotates about rod in a clockwise direction; (vi) rotating member rotates about rod 19*a* in a clockwise direction, rotating member 22 is stationary, and rotating member 24 rotates about rod 19*c* in a counter clockwise direction; (vii) rotating member 20 rotates about rod 19*a* in a counter clockwise direction, rotating member 22 is stationary, and rotating member 24 rotates about rod 19*c* in a clockwise direction; (viii) rotating member 20 rotates about rod 19*a* in a counter clockwise direction, rotating member 22 is stationary, and rotating member 24 rotates about rod 19*c* in a counter clockwise direction; (ix) rotating member 20 rotates about rod 19*a* in a clockwise direction, rotating member 22 rotates about rod 19*b* in a counter clockwise direction, and rotating member 24 is stationary; (x) rotating member 20 rotates about rod 19*a* in a counter clockwise direction, rotating member 22 rotates about rod 19*b* in a counter clockwise direction, and rotating member 24 is stationary; (xi) rotating member 20 rotates about rod 29*a* in a counter clockwise direction, rotating member 22 rotates about rod 19*b* in a clockwise direction, and rotating member 24 is stationary; (xii) rotating member 20 rotates about rod 19*a* in a clockwise direction, rotating member 22 rotates about rod 19*b* in a clockwise direction, and rotating member 24 is stationary; (xiii) rotating members 20 and 22 are stationary, and rotating member 24 rotates about rod 19*c* in a counter clockwise direction; (xiv) rotating members 20 and 22 are stationary, and rotating member 24 rotates about rod 19*c* in a clockwise direction; (xv) rotating members 20 and 24 are stationary and rotating member 22 rotates about rod 19*b* in a clockwise direction; (xvi) rotating members 20 and 24 are stationary and rotating member 22 rotates about rod 19*b* in a counter clockwise direction; (xvii) rotating member 20 rotates about rod 19*a* in a counter clockwise direction, and rotating members 22 and 24 are stationary; and (xviii) rotating member 20 rotates about rod 19*a* in a clockwise direction, and rotating members 22 and 24 are stationary.

And any of rods 19*a*, 19*b*, 19*c*, in FIG. 1A, rods 42*a*, 42*b* and 42*c* in FIG. 2A and FIG. 2B, and/or rods 60*a*, 60*b*, and 60*c* in FIGS. 3A, 3B, 3C may have two or more spaced rotating members, either integral therewith or rotatable thereabout. In such an embodiment, the spacing of multiple rotating members on a rod may be identical or different, depending on the intended resulting rotation of the spherical golf ball component about its center. Additionally, rotating members may have any shape or dimension or spatial relationship capable of supporting and rotating the spherical golf ball component in any direction about its center.

Rotating members may also be adjustably mounted about rods such that each rotating member may traverse or progress along its respective rod while rotating about the rod in order to urge the spherical golf ball component in a particular direction about its center.

Figure 4A:
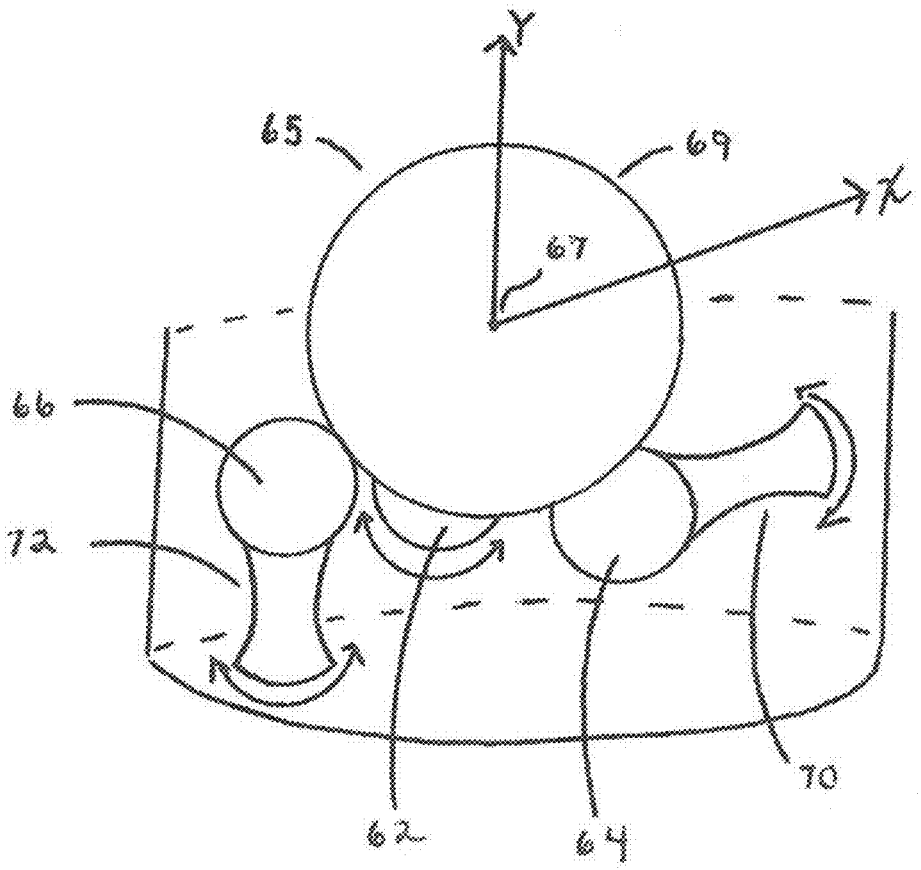
FIG. 4A is a pictorial view of still another embodiment of a rotation support having two rotating members that are orthogonal to one other rotating member for rotating a spherical golf ball component in any direction about its center.
Figure 48:
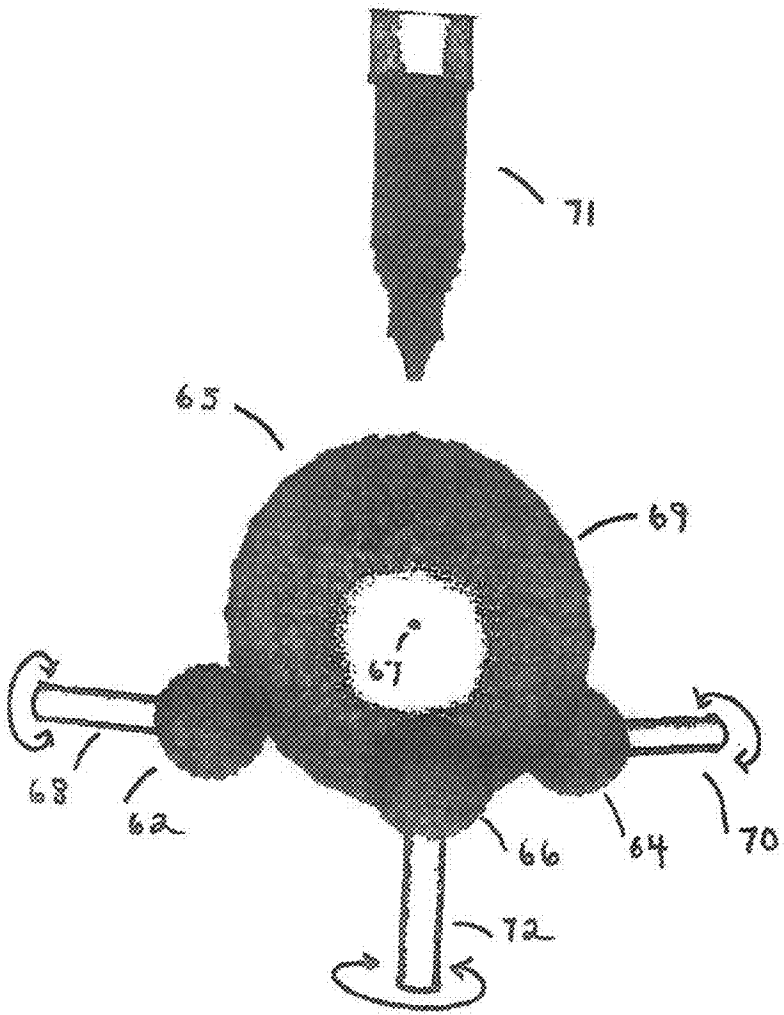
Figure 4C:
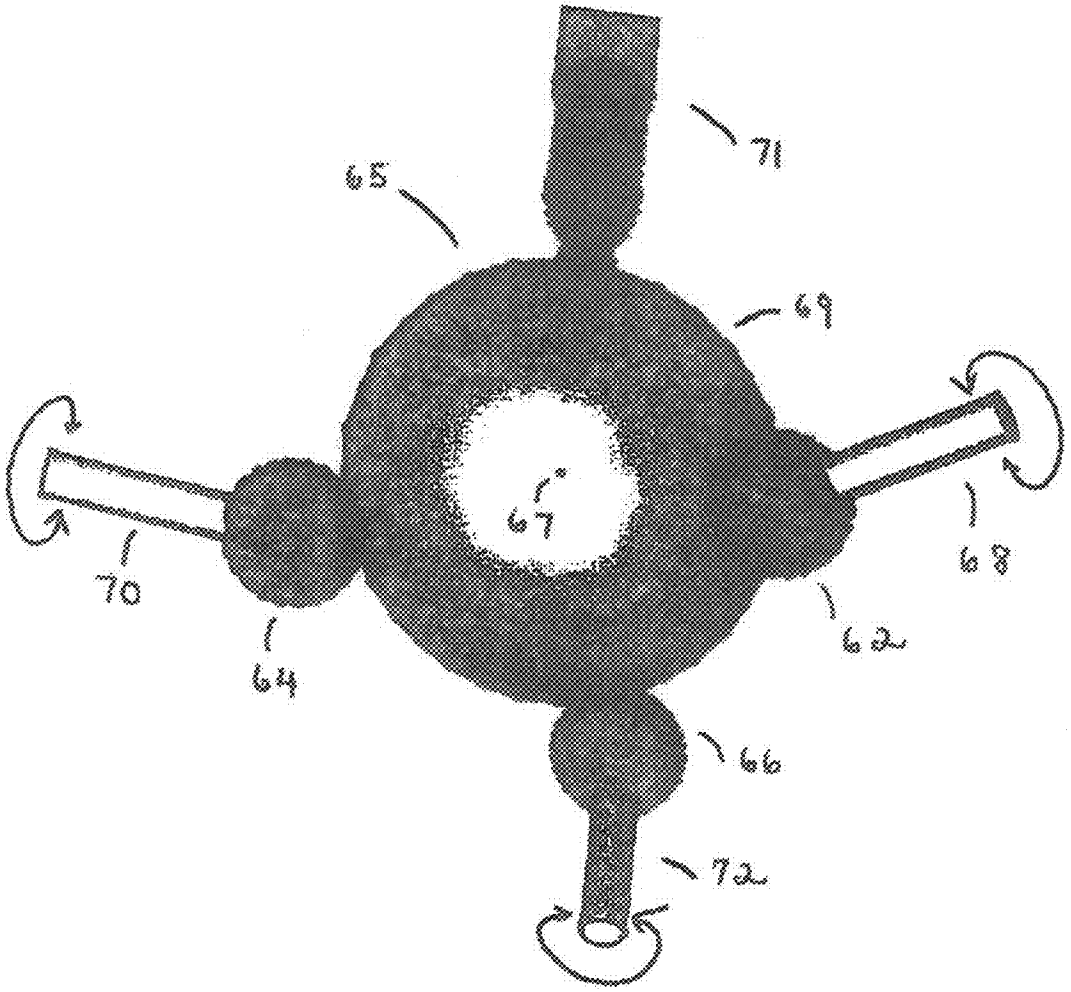
FIG. 4C is a bottom view of the rotation support depicted in FIG. 4A.

The rods may be orthogonal. For example, in FIG. 4A, FIG. 4B, and FIG. 4C, rotating members 62 and 64 are rotatable about the x-axis and rod 66 is rotatable about the y axis. Rods 68 (not shown in FIG. 4A), 70, and 72 may be integral with rotating members 62, 64, and 66, respectively. Alternatively, rods 68, 70 and 72 may be rotatably attached/secured to rotating members 62, 64, and 66, respectively. Rotating members 62, 64 and 68 cooperate to rotate golf ball 65 in any direction about its center 67 while a marker 71 (not shown in FIG. 4A) marks outer surface 69.

Figure 5A:
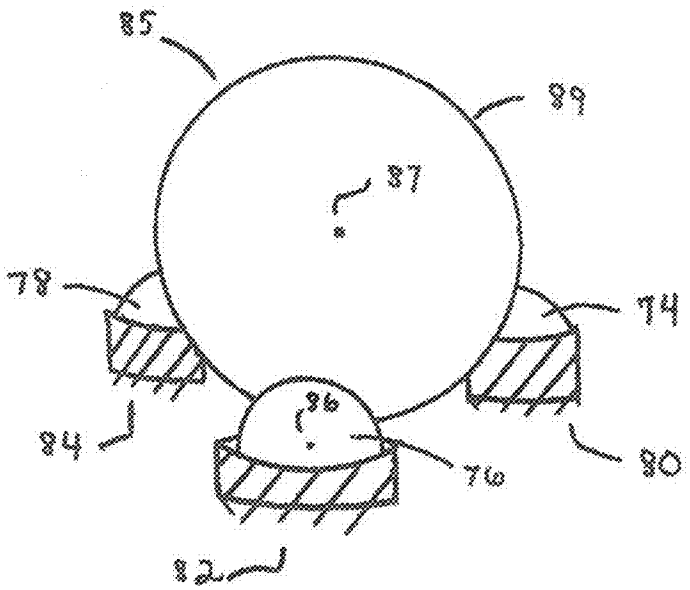
FIG. 5A illustrates a rotation support including three socket-type rotating members for rotating a spherical golf ball component in any direction about its center according to a different embodiment of the invention.
Figure 5B:
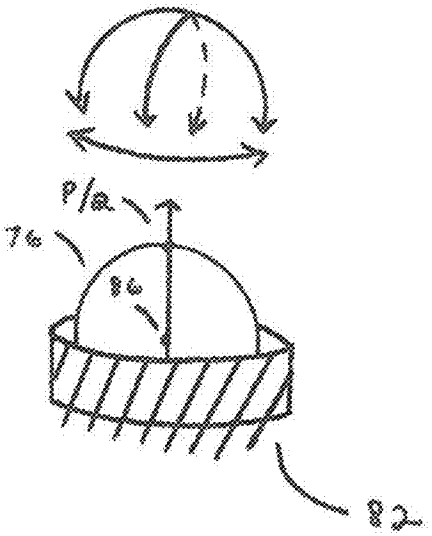
FIG. 5B depicts a single socket-type rotating member.
Figure 5C:
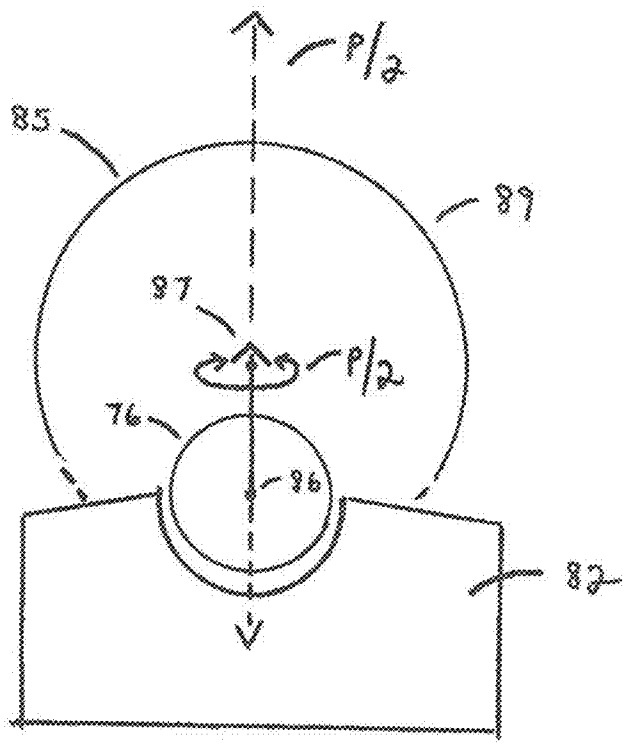
FIG. 5C depicts a side view of a rotation support incorporating an alternative socket-type rotating member arrangement.

As shown in FIG. 5A, FIG. 5B and FIG. 5C, spherical rotation members 74, 76, and 78 may be rotatably housed within sockets 80, 82, and 84, respectively. In this embodiment, each socket has a mechanism for rotating a spherical rotating member within a socket in any direction about the spherical rotating member's own center 86. For example, a spherical rotating member may be formed from a material that permits the mechanism to rotate the spherical rotating member within the socket via electro magnetism. Rotating members 74, 76 and 78 cooperate to rotate golf ball 85 in any direction about its center 87 while a marker (not shown) marks outer surface 89.

In many embodiments, the marking arm may be movable before, during and/or following the golf ball marking step as selected or predetermined. In some embodiments, a marking arm may optionally be motionless during the entire marking process, or alternatively be motionless at least temporarily while marking the spherical golf ball component.

For example, the device for marking a spherical golf ball component can comprise the at least one rotation support and at least one spherical golf ball component having a center and an outer surface as discussed in detail above. However, in this embodiment, the spherical golf ball component is mountable on the rotation support such that the spherical golf ball component is rotatable in any direction about its center and the marking arm is not moved during at least a portion of the marking process. The marking arm can mark the outer surface while the spherical golf ball component is rotating in any direction such that any indicia or other marking can be applied onto the outer surface. While it is preferred that the marking arm remain motionless while marking the spherical golf ball component in this embodiment, it is still preferred that the marking arm be able to move in a direction perpendicular to the outer surface of the golf ball component. This can enable the marking arm to more readily mark an uneven surface that has dimples, for example. It also enables the marking arm to be moved perpendicularly away from the marking surface after the marking process has been completed to enable the golf ball component to be more readily removed from the marking station.

Alternatively, the marking arm may be motionless only temporarily while marking the spherical golf ball component. For example, the marking arm may be moved into marking contact with the outer surface and the marking process is partially or substantially completed with the marking arm remaining stationary. However, the arm may need to be moved in order to create a two-part indicia, for example. Thus, after a first portion of the marking indicia has been finished, the marking arm may be raised perpendicularly away from the outer surface while the golf ball component is then rotated to a different section and the marking arm is then lowered back onto the outer surface to begin a second marking process. Following this process, multiple markings or indicia can be created on the outer surface of the golf ball component without ever removing the golf ball component from the marking station.

Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

While it is apparent that the illustrative embodiments of the invention disclosed herein fulfill the objective stated above, it is appreciated that numerous modifications and other embodiments may be devised by those skilled in the art. Therefore, it will be understood that the appended claims are intended to cover all such modifications and embodiments, which would come within the spirit and scope of the present invention.

What is claimed is:

1. A device for marking a spherical golf ball component, comprising:

at least one rotation support;

at least one spherical golf ball component having a center and an outer surface;

wherein each spherical golf ball component is mountable on the rotation support such that the spherical golf ball component is rotatable in any direction about its center while being marked with a predetermined pattern without interruption;

the rotation support comprising at least three rods, each rod having an integral spherical rotating member; wherein at least one rod is rotatable about the x-axis and is orthogonal to at least two parallel rods that are rotatable about the y axis; and wherein all spherical rotating members collectively support and rotate the spherical golf ball component in any direction about its center; and at least one marking arm having n degrees of freedom with respect to the outer surface, wherein $n \geq 2$; and wherein the at least one marking arm is movable to mark any portion of the outer surface with the predetermined pattern while the spherical golf ball component is rotating.

2. The device of claim 1, wherein the spherical golf ball component comprises at least one of a core; a core and an intermediate layer; a core and a cover, and a core, an intermediate layer and a cover.

3. The device of claim 2, wherein a coating layer is disposed about the spherical golf ball component.

4. The device of claim 1, wherein each rod is rotatable in at least one of a clockwise and counterclockwise direction.

5. The golf ball of claim 4, wherein the at least one rod is rotatably secured to a first platform and the at least two parallel rods are rotatably secured to a second platform; wherein the first platform is orthogonal to the second platform; and wherein the first platform has at least one edge that is mated to at least one edge of the second platform.

6. The device of claim 1, wherein each marking arm is extendable and retractable to mark the outer surface of the spherical golf ball component as the spherical golf ball component rotates in any direction about its center.

7. The device of claim 1, wherein each marking arm is movable above an arc about the spherical golf ball component center.

8. The device of claim 1, wherein the marking arm comprises at least one of a pen, a brush, an air brush, a sprayer, an applicator, a cutting instrument, a needle, an etching tool, and a cutting tool.

9. The device of claim 1, comprising at least two marking arms that are arranged such that they can mark the spherical golf ball surface simultaneously.

10. The device of claim 1, comprising at least two marking arms that are arranged such that they can mark the spherical golf ball surface sequentially.

11. The device of claim 1, wherein the at least one marking arm uses one of the $n \geq 2$ degrees of freedom to mark the outer surface while the spherical golf ball component rotates in a plurality of directions about its center.

12. The device of claim 1, wherein the spherical golf ball component is directly rotatable about at least three of P/2 axes, wherein P is the number of preselected contact points on the outer surface that are contacted by the marking arm during the marking process.

13. The device of claim 1, wherein the spherical golf ball component is directly rotatable about A axes, wherein $2 \leq A \leq P/2$, wherein P is the number of preselected contact points on the outer surface that are contacted by the marking arm during the marking process.

14. The device of claim 1, wherein a processing device assigns a portion of the predetermined marking pattern to each marking arm and coordinates marking of the outer surface by each marking arm while the spherical golf ball component rotates about the center.

15. The device of claim 1, wherein the marking arm is motionless at least temporarily while marking the spherical golf ball component.

* * * * *